US008132517B2

(12) United States Patent
Leng

(10) Patent No.: US 8,132,517 B2
(45) **Date of Patent: *Mar. 13, 2012**

(54) FOLDABLE TABLE AND A FOLDABLE BENCH

(75) Inventor: Luhao Leng, Fujian (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 176 days.

This patent is subject to a terminal disclaimer.

(21) Appl. No.: 12/602,658

(22) PCT Filed: Jun. 25, 2008

(86) PCT No.: PCT/CN2008/071415

§ 371 (c)(1), (2), (4) Date: Dec. 2, 2009

(87) PCT Pub. No.: WO2009/000199

PCT Pub. Date: Dec. 31, 2008

(65) Prior Publication Data

US 2010/0175594 A1 Jul. 15, 2010

(30) Foreign Application Priority Data

Jun. 28, 2007 (CN) ..... 2007 2 0007488 U

(51) Int. Cl.
*A47B 3/00* (2006.01)

(52) U.S. Cl. ..... 108/133; 108/132; 248/439

(58) Field of Classification Search ..... 108/117, 108/120, 129, 131–133; 248/166, 439
See application file for complete search history.

(56) References Cited

U.S. PATENT DOCUMENTS

| | | | | | |
|---|---|---|---|---|---|
| 1,859,588 | A * | 5/1932 | Kehrer | ..... | 108/132 |
| 1,872,833 | A * | 8/1932 | Silverman | ..... | 108/132 |
| 2,089,318 | A * | 8/1937 | Willson | ..... | 108/131 |
| 2,596,267 | A * | 5/1952 | McKinnie | ..... | 108/117 |
| 2,614,348 | A * | 10/1952 | Buser | ..... | 108/117 |
| 2,653,399 | A * | 9/1953 | McKinnie | ..... | 248/164 |
| 2,671,974 | A * | 3/1954 | McKinnie | ..... | 108/117 |
| 3,072,451 | A * | 1/1963 | Greenberg et al. | ..... | 108/160 |
| 5,454,575 | A * | 10/1995 | Del Buono | ..... | 280/35 |
| 6,634,304 | B2 * | 10/2003 | Wang | ..... | 108/129 |

(Continued)

FOREIGN PATENT DOCUMENTS

CN 1202806 A 12/1998

(Continued)

*Primary Examiner* — Hanh V Tran
(74) *Attorney, Agent, or Firm* — Rabin & Berdo, P.C.

(57) ABSTRACT

A supporting portion for a foldable table or a foldable bench is described. The supporting portion includes a V-shaped assembly and a supporting brace. The V-shaped assembly includes two connecting rods and a sliding sleeve. Each of the connecting rods has a disconnected end and a connected end. The connected ends are connected to opposite sides of the sliding sleeve to form a unitary block. The sliding sleeve includes a front ring, a rear ring and a middle piece. The middle piece has a locking hole. The disconnected ends are rotatably connected to a pair of legs respectively. One end of the supporting brace is connected to the undersurface of the table or bench top, and the other end is adapted to slide through the sliding sleeve. The supporting brace has an elastic pin proximate to the other end. When the foldable table or bench is in unfolded position, the elastic pin is inserted into the locking hole.

10 Claims, 3 Drawing Sheets

U.S. PATENT DOCUMENTS

| | | | | |
|---|---|---|---|---|
| 6,705,234 | B1 | 3/2004 | Miller et al. | |
| 6,877,441 | B2 * | 4/2005 | Zheng | 108/130 |
| 7,055,899 | B2 * | 6/2006 | Zhurong et al. | 297/158.4 |
| 2003/0121460 | A1 * | 7/2003 | Lou-Hao | 108/132 |

FOREIGN PATENT DOCUMENTS

| | | | |
|---|---|---|---|
| CN | 2339063 | Y | 9/1999 |
| CN | 2564001 | Y | 8/2003 |
| CN | 2599983 | Y | 1/2004 |
| CN | 1692856 | A | 11/2005 |
| CN | 2815083 | Y | 9/2006 |
| DE | 4321853 | A1 | 1/1995 |
| DE | 29617522 | U1 | 1/1997 |

* cited by examiner

FOLDABLE TABLE AND A FOLDABLE BENCH

FIELD OF THE INVENTION

The present invention relates to a foldable table and a foldable bench.

BACKGROUND OF THE INVENTION

The foldable table in prior art generally comprises a table top, a leg portion and a supporting portion, the upper end of the leg portion formed rotatable connection with the table top, and the supporting portion comprises a first pivotal-connection portion for pivotally connecting with the leg portion, a second pivotal-connection portion for pivotally connecting with the table top and a ring, the first pivotal-connection portion pivotally connected with the second pivotal-connection portion, the table top, the leg portion, the first pivotal-connection portion and the second pivotal-connection portion formed a four-rod folding mechanism, after being unfolded, the folding mechanism is fixed in an unfolded position by the ring which limit the rotation between the first pivotal-connection portion and the second pivotal-connection portion. After being unfolded, the ring shelved on the connecting portion between the first pivotal-connection portion and the second pivotal-connection portion to prevent they rotating relative to each other, but this locking by the ring is unstable, accordingly, the table is unstable.

SUMMARY OF THE INVENTION

The primary object of the present invention is to provide a folding table and a foldable bench which obviate the problem aforementioned that the table has disadvantages such as unstable locking so that the entire table is unstable.

This object is achieved by providing: A foldable table comprising a table top, a leg portion and a supporting portion, the top end of said leg portion formed rotatable connection with said table top, wherein said supporting portion comprising a V-shaped assembly and a supporting brace, said V-shaped assembly comprising two connecting rods and a sliding sleeve, said connecting rods are provided with disconnected ends and connected ends, said connected ends clamp the sliding sleeve and are fixed into one block, said disconnected ends are rotatably connected to a pair of legs respectively; one end of the supporting brace is connected to the undersurface of said table top, and the other end can slide through the sliding sleeve; and when the foldable table is in unfolded position, the connected ends of the connecting rod connected to the leg portion is locked with the supporting brace via the sliding sleeve.

In one preferred embodiment of the present invention, the connected ends of said two connecting rods are connected with the sliding sleeve by welding.

In one preferred embodiment of the present invention, the foldable table further comprises a locking device comprising an elastic pin disposed in said supporting brace and a locking hole disposed in said sliding sleeve, said elastic pin can insert into said locking hole by the action of elasticity.

In one preferred embodiment of the present invention, the rear end of said sliding sleeve is configured into a guide inlet corresponding to the elastic pin, the distance between said guide inlet and said supporting brace is decreased gradually from rear to front.

In one preferred embodiment of the present invention, the foldable table comprises two pairs of legs which formed a splayed structure in unfolded position.

This object is also achieved by providing: A foldable bench comprising a bench top, a leg portion and a supporting portion, the top of said leg portion formed rotatable connection with said bench top, wherein said supporting portion comprising a V-shaped assembly and a supporting brace, said V-shaped assembly comprising two connecting rods and a sliding sleeve, said connecting rods are provided with disconnected ends and connected ends, said connected ends clamp the sliding sleeve and are fixed into one block, said disconnected ends are rotatably connected to a pair of legs respectively; one end of the supporting brace is connected to the undersurface of said table top, and the other end can slide through the sliding sleeve.

In one preferred embodiment of the present invention, the connected ends of said two connecting rods are connected with the sliding sleeve by welding.

In one preferred embodiment of the present invention, the foldable bench further comprises a locking device comprising an elastic pin disposed in said supporting brace and a locking hole disposed in said sliding sleeve, said elastic pin can insert into said locking hole by the action of elasticity.

In one preferred embodiment of the present invention, the rear end of said sliding sleeve is configured into a guide inlet corresponding to the elastic pin, the distance between said guide inlet and said supporting brace is decreased gradually from rear to front.

In one preferred embodiment of the present invention, the foldable bench comprises two pairs of legs which formed a splayed structure in unfolded position.

According to the foldable mechanism of the foldable table and the foldable bench of the present invention, the sliding sleeve suffers for great force in unfolded position, accordingly, high stability and firmness are required for the invention. As the connected ends of the two connecting rods clamp the sliding sleeve and are fixed into one block, the fixation stability and firmness of the sliding sleeve are high. The connected ends of said two connecting rods are connected with the sliding sleeve by welding, thus the fixation stability and firmness of the sliding sleeve are high, convenient and rapid manufacture. The distance between said guide inlet and said supporting brace is decreased gradually from rear to front, thus the elastic pin can be compressed gradually by the guide inlet so as to be pressed into the sliding sleeve until slide to the locking hole, in which the elastic pin will insert into the locking hole by the action of elasticity.

BRIEF DESCRIPTION OF THE DRAWINGS

To better understand the invention, a more particular description of the invention will be rendered by reference to the appended drawings.

in these figures.

Figure 1:
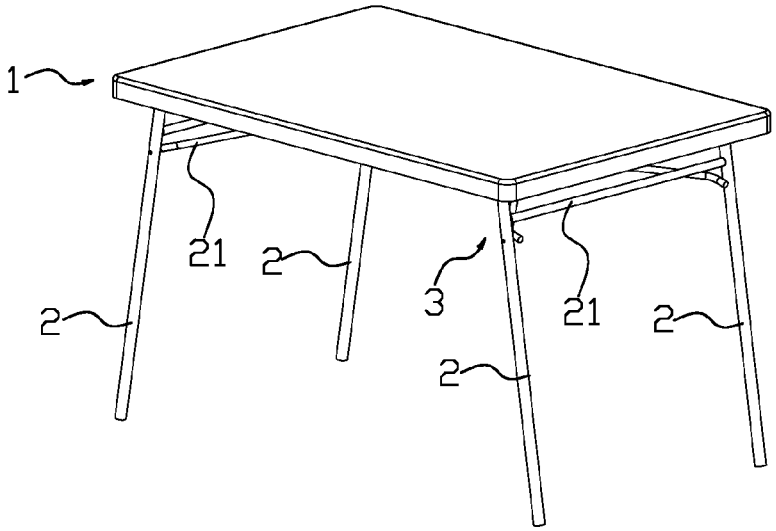
FIG. 1 is a perspective view of the foldable table in embodiment 1 of the present invention.

table top 1, vacuum-forming plastic board 11, side rail 12 central bar 13;

leg 2, cross pole 21;

supporting portion 3, V-shaped assembly 31, supporting brace 32, connecting rod 311, sliding sleeve 312, front ring 3121, rear ring 3122, middle piece 3123, locking hole 3124, guide inlet 3125, elastic pin 321.

Bench top 4, vacuum-forming plastic board 41, side rail 42, central bar 43.

DETAILED DESCRIPTION OF THE PREFERRED EMBODIMENTS

Embodiment 1

Figure 2:
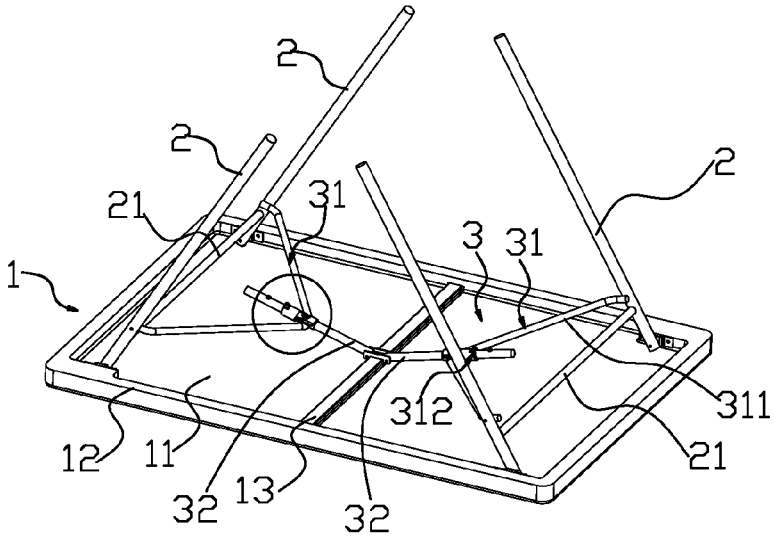
FIG. 2 is a perspective view of the foldable table in embodiment 1 of the present invention in unfolded position.
Figure 3:
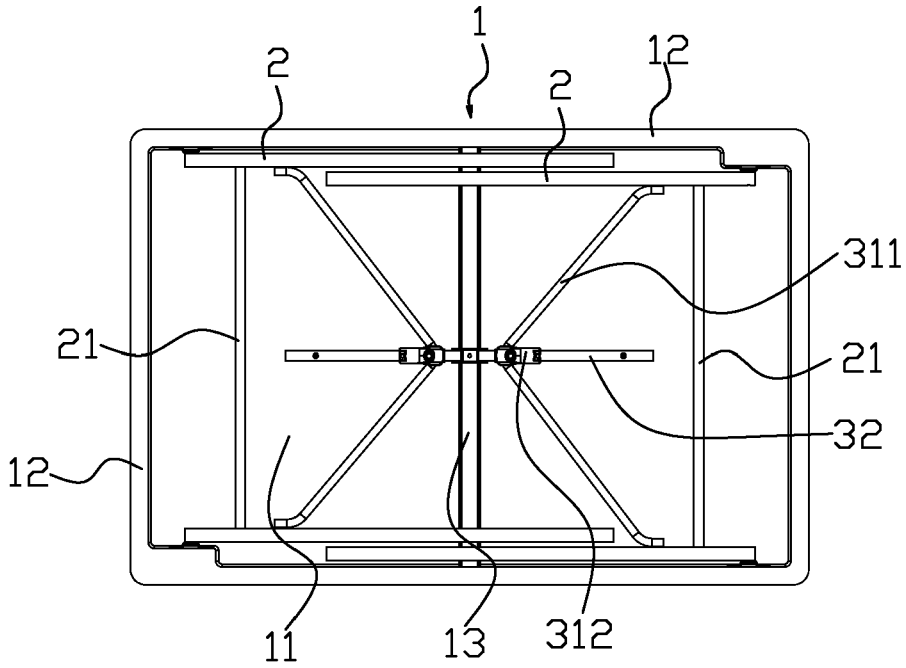
FIG. 3 is a bottom view of the foldable table in embodiment 1 of the present invention in folded position.

Referring to FIG. 1 to FIG. 3, a foldable table comprises a table top 1, four legs 2 and two supporting portion 3, the upper end of each leg can rotatably connect to the table top 1, and the supporting portions 3 are disposed between the table top 1 and legs 2.

The table top comprises a vacuum-forming plastic board 11. The vacuum-forming plastic board comprises a plastic top plate, a plastic bottom plate, honeycombs, and lining, the top plate and the bottom plate fixedly adhered to the top and the bottom of the honeycomb respectively, the lining sandwiched between the top plate and bottom plate and covering the honeycomb entirely or partially. Both the plastic top plate and the plastic bottom plate are plastic composite plate manufactured by vacuum-molded board or extruded board, and they can be single-layer or multiple-layer, the thickness of the plastic composite board is between 0.3 mm to 0.4 mm. The material consisted of the plastic composite board can be ABS, PP or PS etc. the surface of the plastic composite board is composite by a printing layer with various nature colors and texture such as wood grains or marble; or composite a film layer with various nature colors and texture such as wood grains or marble; then remove the film after transferring, and spray thermo curing or UV-curing varnish to reinforce the rigidity and weatherability of the surface. The superposition edges of the vacuum molded plastic bottom plate and plastic top plate connected to each other by welding or gluing, the superposition edges can be set in side or in bottom. The lining is a closed or U-shaped or H-shaped frame made by pipe fittings or profiles or hardware, or made by composite part consisted of pipe fittings or profiles or hardware or injection part, the lining is used for reinforcing the intension of the table top or connecting the other structure to reinforce the connecting intension to the other structure. Reinforce member embedded in the corner of the lining connected to the frame by clamping or screw thread or welding can reinforce the corner and act connecting function. Referring to FIG. 3, the plastic bottom plate and the lining of the plastic board cooperated to each other to form side rails 12, and a central bar 13 is disposed in the center of the side rails 12.

Referring to FIG. 1 and FIG. 3, in the four legs 2, two of which namely first legs 2 are pivotally connected to the side rails 12 of the vacuum-forming plastic board 11, and a cross pole 21 is fixed between the two legs 2. The other two legs 2 namely second legs 2 are also pivotally connected to the side rails 12, and another cross pole 21 is fixed between these other two legs 2. Herein in unfolded state, the first legs 2 and the second legs 2 are formed a splayed shape which can improve the stability of the table.

Figure 4:
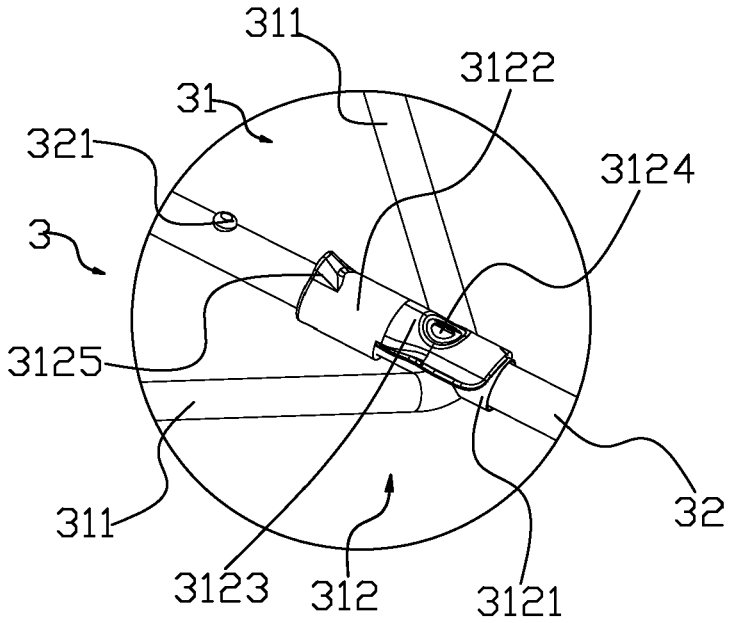
FIG. 4 is a partial enlarged view of A portion in FIG. 1.

Referring to FIG. 2, the supporting portion 3 comprises a V-shaped assembly 31 and a supporting brace 32. Referring to FIG. 4, the V-shaped assembly comprises two connecting rods 311 and a sliding sleeve 312. The sliding sleeve 312 comprises a front ring 3121, a rear ring 3122 and a middle piece 3123, the middle piece 3123 disposed between the front ring 3121 and the rear ring 3122 and they fixed to be one entirety. The middle piece 3123 is provided with a locking hole 3124, and the middle-lower portion of the rear portion of the rear ring 3122 is configured to be a guide inlet 3125. The connecting rods 311 are provided with disconnected ends and connected ends, the connected ends of the two connecting rods 311 clamp the front ring 3121 of the sliding sleeve 312, and fixed to the sliding sleeve 312 by welding. The supporting brace 32 is a hollow pipe and is provided with an elastic pin 321 inside, which is extended out from the supporting brace 32 by the top end pass through a through hole which connected the inside and outside of the supporting brace 32 by the action of the elasticity. a locking device is formed by the elastic pin 321, through hole and the locking hole 3124.

Referring to FIG. 2 to FIG. 4, the first end of the supporting brace 32 is pivotally connected to the central bar 13 and the second end slidably pass through the front ring 3121 and rear ring 3122 of the sliding sleeve 312, the distance between the inner wall of the guide inlet 3125 and the supporting brace 32 is decreased gradually from rear to front.

When the foldable table is in unfolded state, the elastic pin 321 of the supporting brace 32 is inserted into the locking hole 3124 of the middle piece 3123. The disconnected ends of the two connecting rods 311 of the V-shaped assembly pivotally connected to the two first legs 2 respectively or to the two second legs 2 respectively; the connected ends of the connecting rods 311 are fixed to the supporting brace 32 by locking connection via the sliding sleeve 312.

Embodiment 2

Figure 5:
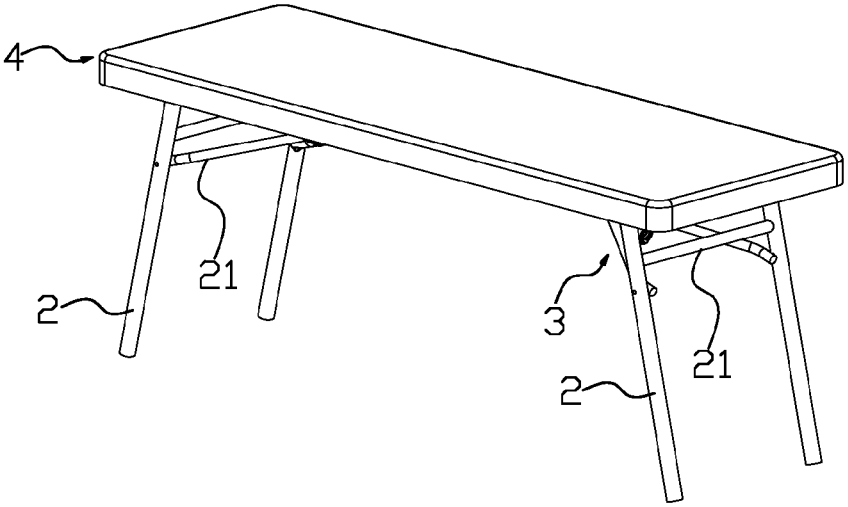
FIG. 5 is a perspective view of the foldable table in embodiment 2 of the present invention.
Figure 6:
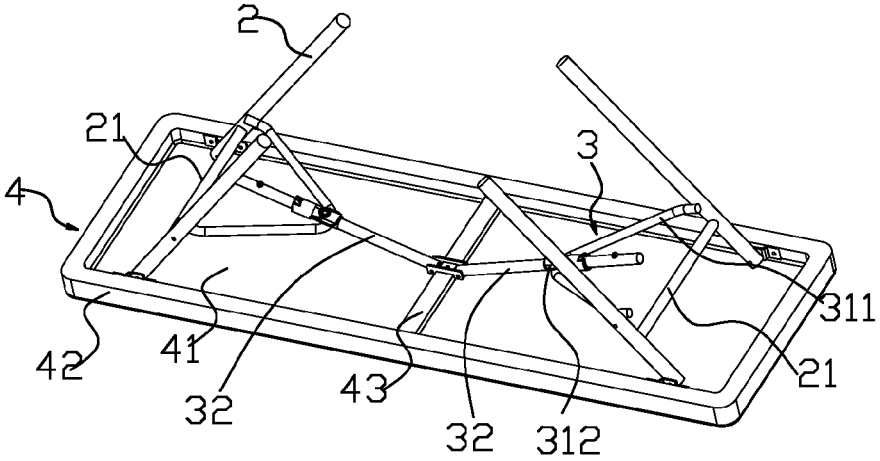
FIG. 6 is a perspective view of the foldable table in embodiment 2 of the present invention in unfolded position.

Referring to FIG. 5 and FIG. 6, the difference between this embodiment to embodiment 1 is that in this embodiment, the product is a foldable bench, which has similar structure to the foldable table of embodiment 1.

Industrial Applicability

The foldable table or foldable bench of the present invention, the sliding sleeve can bear strong force in unfolded state, thus the invention has high stability and safety application.

What is claimed is:

1. A foldable table, comprising a table top, a leg portion and a supporting portion, a top end of said leg portion forming a rotatable connection with said table top, said supporting portion comprising:

a V-shaped assembly, said V-shaped assembly comprising two connecting rods and a sliding sleeve, each of said two connecting rods having a disconnected end and a connected end, said connected ends being connected to opposite sides of the sliding sleeve to form a unitary block, said sliding sleeve comprising a front ring, a rear ring and a middle piece, said middle piece having a locking hole, said disconnected ends being rotatably connected to a pair of legs respectively;

a supporting brace having a first end and a second end, the first end being connected to an undersurface of said table top, and the second end being adapted to slide through the sliding sleeve, the supporting brace having an elastic pin proximate to the second end;

wherein when the foldable table is in an unfolded position, the elastic pin is inserted into the locking hole.

2. The foldable table according to claim 1, wherein the connected ends of said two connecting rods are welded with the sliding sleeve.

3. The foldable table according to claim 1, wherein the rear ring of said sliding sleeve comprises a guide inlet corresponding to the elastic pin.

4. The foldable table according to claim 1, wherein the foldable table comprises two pairs of legs which form a splayed structure in an unfolded position.

5. The foldable bench according to claim 4, wherein the rear ring of said sliding sleeve comprises a guide inlet corresponding to the elastic pin.

6. The foldable table according to claim 2, wherein the foldable table comprises two pairs of legs which form a splayed structure in an unfolded position.

7. A foldable bench, comprising a bench top, a leg portion and a supporting portion, a top of said leg portion forming a rotatable connection with said bench top, said supporting portion comprising:

a V-shaped assembly, said V-shaped assembly comprising two connecting rods and a sliding sleeve, each of said two connecting rods having a disconnected end and a connected end, said connected ends being connected to opposite sides of the sliding sleeve and to form a unitary block, said sliding sleeve comprising a front ring, a rear ring and a middle piece, said middle piece having a locking hole, said disconnected ends being rotatably connected to a pair of legs respectively;

a supporting brace having a first end and a second end, the first end being connected to an undersurface of said table top, and the second end being adapted to slide through the sliding sleeve, the supporting brace having an elastic pin proximate to the second end;

wherein when the foldable bench is in an unfolded position, the elastic pin is inserted into the locking hole.

8. The foldable bench according to claim 7, wherein the connected ends of said two connecting rods are welded with the sliding sleeve.

9. The foldable bench according to claim 7, wherein the foldable bench comprises two pairs of legs which form a splayed structure in an unfolded position.

10. The foldable bench according to claim 8, wherein the foldable bench comprises two pairs of legs which form a splayed structure in an unfolded position.

* * * * *